United States Patent [19]

Wax

[11] Patent Number: 5,041,049

[45] Date of Patent: Aug. 20, 1991

[54] ACTION TOY

[76] Inventor: William C. Wax, 1713 Dorcas, Apt. #2, Omaha, Nebr. 68108

[21] Appl. No.: 568,115

[22] Filed: Aug. 16, 1990

[51] Int. Cl.[5] ..... A63H 11/10

[52] U.S. Cl. ..... 446/289; 446/290; 446/269

[58] Field of Search ..... 446/290, 169, 170, 465, 446/269, 270, 289, 271, 273

[56] References Cited

U.S. PATENT DOCUMENTS

| | | | |
|---|---|---|---|
| 811,775 | 2/1906 | Keen et al. | 446/169 |
| 1,209,920 | 12/1916 | Young . | |
| 1,602,561 | 10/1926 | Wetzell | 446/ |
| 2,787,970 | 4/1957 | Bennett | 105/95 |
| 3,462,148 | 6/1969 | Fors | 446/170 |
| 3,529,378 | 9/1970 | Kinberg | 446/270 |

FOREIGN PATENT DOCUMENTS

| | | | |
|---|---|---|---|
| 50470 | 9/1966 | Fed. Rep. of Germany . | |
| 593274 | 5/1959 | Italy | 446/465 |

*Primary Examiner*—Robert A. Hafer
*Assistant Examiner*—David J. Kenealy
*Attorney, Agent, or Firm*—Henderson & Sturm

[57] ABSTRACT

A directional control for small action toys. The toy includes a spherical ball lead element which directs the movement and direction of the toy in a downhill gravity path and a pair of trailing ground wheels which bear the weight of the body and chassis of the toy. The ground wheels are positioned at the balance point of the toy to keep the weight of the toy off of the spherical ball to enhance turning performance. A removable retainer secures the spherical ball in position and allows easy removal of the ball for cleaning.

6 Claims, 2 Drawing Sheets

ACTION TOY

TECHNICAL FIELD

This invention relates to toys, and more particularly to a directional control for small action toys.

BACKGROUND ART

Toys are an important tool in helping shape winning life attitudes and behavior in children. Although numerous toys are available, too few are non-violent, real-world toys that provoke thought and promote hand-eye coordination. Action toys typically center on concepts of war or monster-type fantasy instead of constructive real-world environmental and recreational themes. Even constructive action toys are frequently complex in structure and expensive. Therefore, many economically disadvantaged children do not have access to constructive fun action toys with which they can interact and learn.

Those concerned with these and other problems recognize the need for an improved action toy.

DISCLOSURE OF THE INVENTION

The present invention provides a directional control for small action toys. The toy includes a spherical ball lead element which directs the movement and direction of the toy in a downhill gravity path and a pair of trailing ground wheels which bear the weight of the body and chassis of the toy. The ground wheels are positioned at the balance point of the toy to keep the weight of the toy off of the spherical ball to enhance turning performance. A removable retainer secures the spherical ball in position and allows easy removal of the ball for cleaning.

An object of the present invention is the provision of an improved action toy.

Another object is to provide an action toy that is simple in structure and inexpensive to manufacture.

A further object of the invention is the provision of an action toy that constructively promotes interaction and learning.

Still another object is to provide an action toy that is durable and safe.

A still further object of the present invention is the provision of an action toy that is adaptable to a wide variety of constructive themes.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
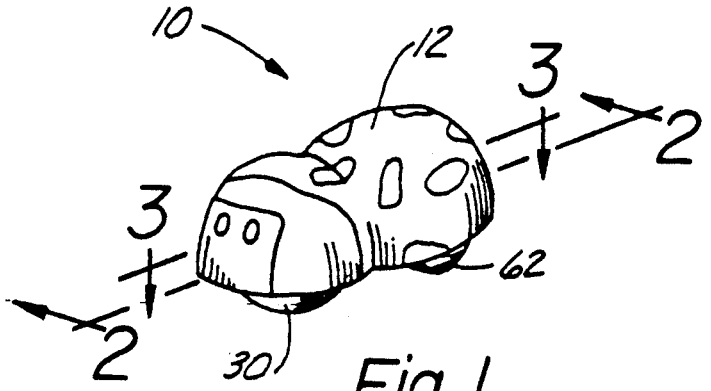
FIG. 1 is a perspective view of the action toy of the present invention wherein the body is shaped in the form of a ladybug.

Referring now to the drawings, wherein like reference numerals designate identical or corresponding parts throughout the several views, FIG. 1 shows the action toy (10) of the present invention. The body (12) of the toy (10) is in the shape of a ladybug; however, it is to be understood that the body design could incorporate a wide variety of creatures such as birds, mammals, reptiles, etc., or even miniature vehicles such as cars, trucks, boats, trains, skateboards, etc.

Figure 4:
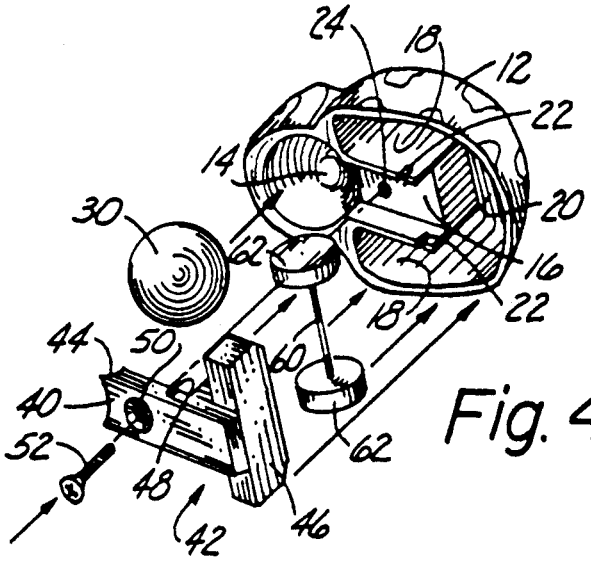
FIG. 4 is an exploded perspective view showing the relative position of the toy components.

As best shown in FIG. 4, the underside of the body (12) has a socket (14) defining a hemisphere, a longitudinal slot (16), wheel wells (18), and a counterweight cavity (20). The sides of the slot (16) have a pair of transversely aligned grooves (22) and a threaded opening (24) is formed at the center of the slot (16).

Figure 2:
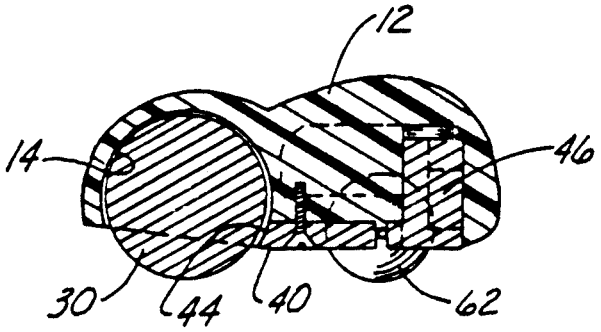
FIG. 2 is a sectional view taken along line 2—2 of FIG. 1.

A spherical ball (30) is received in the socket (14) and is held in position by a retainer (40) which forms the end portion of the chassis (42). The retainer (40) has a surface (44) that forms a continuation of the hemisphere defined by the socket (14) (FIG. 2). A counterweight (46) extends upwardly from the chassis (42). A groove (48) extends across the chassis (42) in registry with the slot grooves (22), and an opening (50) receives a threaded fastener (52). An axle (60) is positioned to engage the registered grooves (22, 48), and a pair of ground wheels (62) are attached to the axle (60).

When the toy (10) is assembled, the axle (60) is positioned at the balance point such that the weight is carried by the ground wheels (62). Since the chassis (42) is matingly received in the slot (16), the single fastener (52) engages the threaded opening (24) to secure all components in position.

Figure 3:
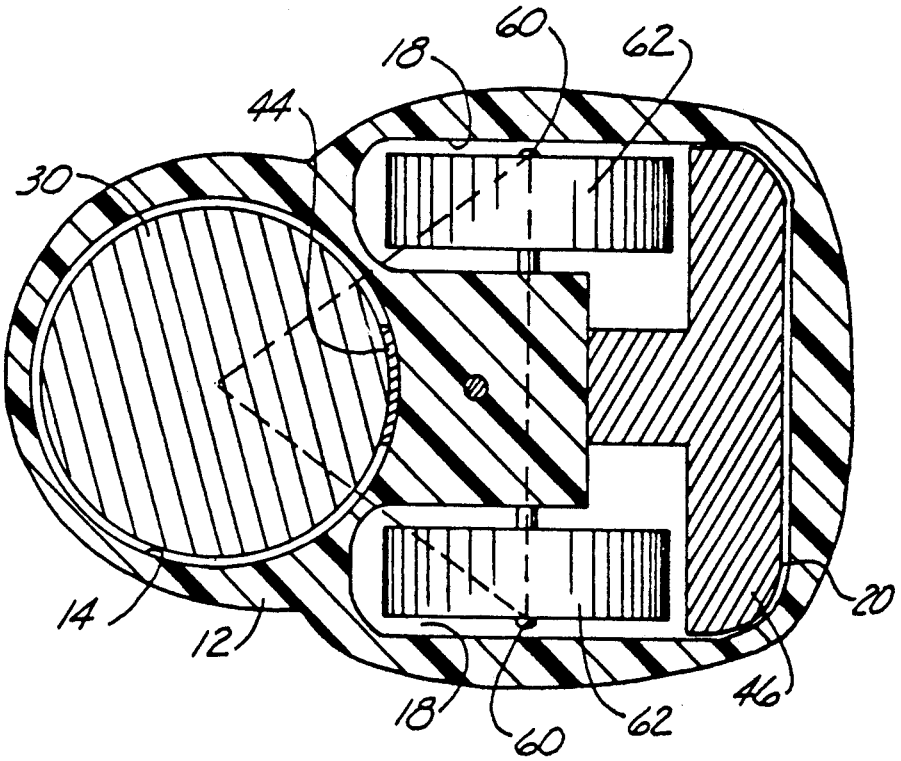
FIG. 3 is an enlarged sectional view taken along line 3—3 of FIG. 1 with a dashed line showing of the relative distances between the outside of the ground wheels and the center of the spherical ball, and illustrating the short footprint or wheelbase that enables movement over uneven contours and promotes stability.
Figure 5:
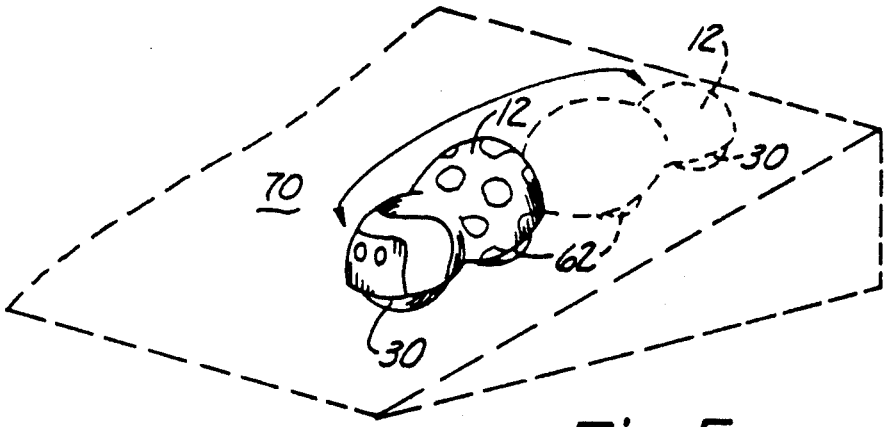
FIG. 5 is a perspective view showing the toy on an inclined surface, and illustrating the toy turning and travelling in the direction of the downhill gradient.
Figure 6:
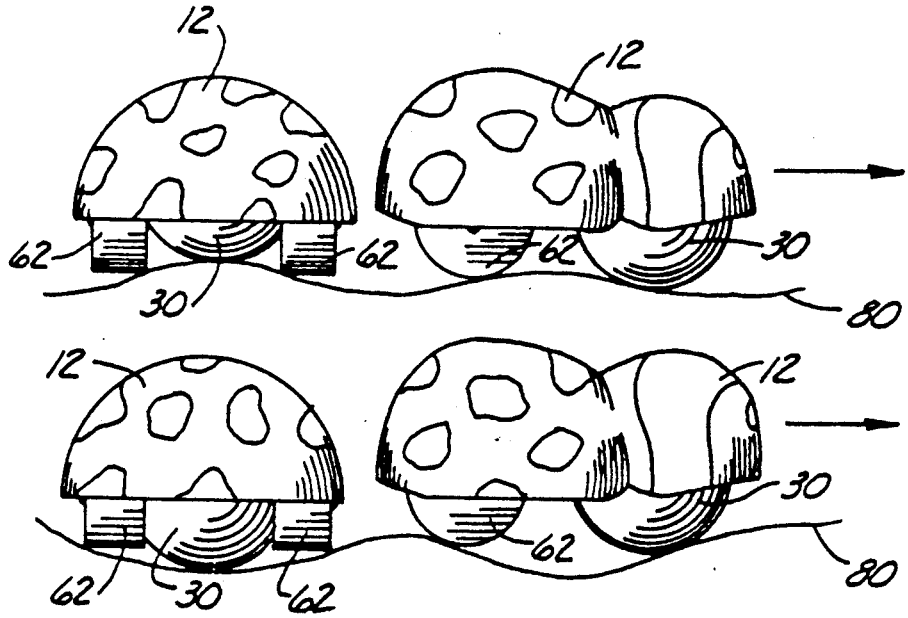
FIG. 6 is a side elevational view showing a number of toys travelling over uneven contours.

When placed on an inclined surface (70), as illustrated in FIG. 5, the toy (10) pivots to point in the direction of the downhill gradient. The ground wheels (62) act as trailers providing directional stability and control while bearing the weight of the chassis (42) and the body (12). The short wheelbase or footprint illustrated in FIG. 3 enables the toy (10) to move over uneven contours while maintaining solid contact with the surface (80) as shown in FIG. 6. The triangular footprint also provides good lateral stability making the toy (10) difficult to overturn and easy to right if it does overturn.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. A toy comprising:

a body having a front section an intermediate section, and a rear section; wherein, the front section is provided with an enlarged socket defining a portion of a hemisphere; the intermediate section is provided with a first groove; and, the end section is provided with an enlarged cavity an enlarged spherical ball disposed in said socket;

an axle equipped with a pair of ground engaging wheels wherein said axle is disposed in said groove; and a counterweight operatively disposed in said enlarged cavity wherein the axle is positioned proximate the balance point of said body.

2. The toy as in claim 1 further including:

a retainer removably attached to said body and having a surface disposed adjacent said socket, said surface forming a continuation of said hemisphere disposed to contact and retain the spherical ball in the socket.

3. The toy as in claim 2; wherein, said retainer is operatively connected to said counterweight.

4. The toy as in claim 3; wherein, the operative connection between the retainer and the counterweight is provided with a second groove that is dimensioned similar to said first groove such that the axle is received within the first and second grooves.

5. The toy as in claim 1; wherein, the axle is disposed below the center of said enlarged spherical ball.

6. The toy of claim 1; wherein, the greatest distance between the wheels is greater than the distance of the axle from the center of the spherical ball.

* * * * *